US007374053B2

(12) United States Patent
Herald et al.

(10) Patent No.: US 7,374,053 B2
(45) Date of Patent: May 20, 2008

(54) TAMPER-INDICATING DISPENSING CLOSURE

(75) Inventors: Coy M. Herald, Ft. Wayne, IN (US); Ramesh Kamath, Carmel, IN (US); David A. Szasz, Crawfordsville, IN (US)

(73) Assignee: Closure Systems International, Inc., Crawfordsville, IN (US)

( * ) Notice: Subject to any disclaimer, the term of this patent is extended or adjusted under 35 U.S.C. 154(b) by 98 days.

(21) Appl. No.: 11/182,138

(22) Filed: Jul. 15, 2005

(65) Prior Publication Data

US 2006/0011573 A1 Jan. 19, 2006

Related U.S. Application Data

(60) Provisional application No. 60/588,439, filed on Jul. 16, 2004.

(51) Int. Cl.
*B65D 47/10* (2006.01)
*B65D 41/58* (2006.01)

(52) U.S. Cl. ..... 215/237; 220/254.3; 220/835; 222/556; 215/253

(58) Field of Classification Search ..... 215/235, 215/237, 253; 220/254.3, 833, 834, 835; 222/556

See application file for complete search history.

(56) References Cited

U.S. PATENT DOCUMENTS

| | | | | | |
|---|---|---|---|---|---|
| 4,170,315 | A * | 10/1979 | Dubach et al. | ..... | 220/281 |
| 4,429,800 | A * | 2/1984 | Greenspan | ..... | 215/216 |
| 4,974,735 | A * | 12/1990 | Newell et al. | ..... | 215/253 |
| 5,685,444 | A | 11/1997 | Valley | | |
| 5,875,907 | A * | 3/1999 | Lay | ..... | 215/253 |
| 6,234,334 | B1 | 5/2001 | Suarez | | |
| 6,347,716 | B1 * | 2/2002 | Nofer et al. | ..... | 215/235 |
| 6,405,885 | B1 | 6/2002 | Elliott | | |
| 6,409,034 | B2 * | 6/2002 | Schorner | ..... | 215/237 |
| 6,484,895 | B2 * | 11/2002 | Montgomery et al. | ..... | 215/237 |

* cited by examiner

*Primary Examiner*—Anthony D. Stashick
*Assistant Examiner*—James N Smalley
(74) *Attorney, Agent, or Firm*—Greenberg Traurig, LLP

(57) ABSTRACT

A tamper-indicating dispensing closure includes a closure body, and an associated flip-top lid pivotally connected to the closure body for movement between a closed position and an open position. The flip-top lid includes a tamper-indicating flange frangibly connected thereto, with the closure body including a pocket-like retention cavity within which the tamper-indicating flange is received during initial closing movement of the flip-top lid. During initial opening movement of the lid, the tamper-indicating flange is broken away from the flip-top lid, and thereafter permanently retained within the retention cavity to provide a clear, visual indication that the flip-top lid of the closure has been opened.

17 Claims, 3 Drawing Sheets

TAMPER-INDICATING DISPENSING CLOSURE

CROSS-REFERENCE TO RELATED APPLICATION

This application claims the benefit of priority Provisional Application No. 60/588,439, filed Jul. 16, 2004, the disclosure of which is incorporated herein by reference.

TECHNICAL FIELD

The present invention relates generally to a dispensing closure having an integral flip-top lid, and more particularly to a dispensing closure having a flip-top lid which includes a tamper-indicating flange frangibly connected thereto, with the flange retained within a retention cavity of the closure when the lid is initially moved from a closed position to an open position for providing visual tamper-indication.

BACKGROUND OF THE INVENTION

Dispensing plastic closures have come into widespread use by virtue of the convenience by which they permit consumers to readily manipulate the closure for dispensing contents from an associated container. This type of closure typically includes a closure body for fitment to the associated container, with the body defining one or more dispensing openings through which the contents of the container can be dispensed. This type of closure further includes a flip-top lid pivotally joined to the closure body, such as by a living hinge, so that the lid can be moved between open and closed positions with respect to the closure body, thereby opening and closing the dispensing opening. These types of closures are particularly useful on flowable food products, such as condiments or the like, with use on deformable (i.e., squeezable) containers further facilitating convenient dispensing.

Closures of this type are exemplified by U.S. Pat. No. 5,685,444, No. 6,234,334, and No. 6,405,885, the disclosures of which are hereby incorporated by reference.

As will be appreciated, it is desirable to provide this type of dispensing closure with a tamper-indicating or tamper-evident feature, whereby consumers can readily visually discern whether the flip-top lid of the closure has been previously opened. While it is known to provide separate seal elements or the like applied to such closures for tamper-indication, the use of such additional sealing elements complicates closure manufacture. It is thus desirable to configure such a dispensing closure to include an integral tamper-indicating arrangement. At the same time, it is desirable that such a tamper-indicating arrangement function without undue complexity, and avoid the need to separate one or more loose components of the closure during initial opening.

The present invention is directed to a one-piece tamper-indicating dispensing closure which can be economically manufactured, is reliable in operation, is easily and conveniently manipulated by consumers, and avoids separation of any loose components during initial opening of the closure.

SUMMARY OF THE INVENTION

The present tamper-indicating dispensing closure includes a closure body, and an associated pivotal flip-top lid. Tamper-indication is provided by a tamper-indicating flange frangibly connected to a main body of the lid, with the closure defining a pocket-like retention cavity within which the flange is received when the lid is initially moved to its closed position. The tamper-indicating flange is retained in the cavity, by fracture of its frangible connection, when the flip-top lid is initially moved from its closed position to an open position, thereby providing clear visual tamper-indication. The tamper-indicating flange is thereafter permanently retained within the retention cavity.

In accordance with the illustrated embodiment, the present closure includes a closure body having a top wall portion, and an annular depending skirt portion. The annular skirt portion may include an internal thread formation, an internal retention bead, internal retention lugs, and the like for effecting securement of the closure body, and thus the dispensing closure, to an associated container.

The top wall portion of the closure body defines a dispensing opening for dispensing contents from the associated container to which the closure body is fitted. For some applications, it can be desirable to provide a plurality of dispensing openings.

The present dispensing closure further includes a flip-top lid, including a main body, joined to the closure body for movement between a closed position covering the dispensing opening, and an open position wherein the dispensing opening is uncovered. The flip-top lid may include a plug element positionable generally within the dispensing opening when the flip-top lid is in its closed position. The flip-top lid is preferably formed integrally with the closure body, and joined thereto by an integral living hinge.

In accordance with the present invention, the flip-top lid includes a tamper-indicating flange depending from the main body of the lid. The tamper-indicating flange is joined to the main body of the lid by a frangible connection which, in the preferred embodiment, comprises a plurality of spaced apart frangible bridges.

For tamper-indication, the closure body defines a retention cavity for receiving the tamper-indicating flange of the flip-top lid when the lid is in its closed position. The tamper-indicating flange is retained in the retention cavity, by fracture of the frangible connection when the flip-top lid is initially moved from its closed position to its open position. The retention cavity is preferably positioned on the closure body opposite the living hinge joined to the flop-top lid to the closure body.

A closure of the present type can be efficiently formed by injection molding, wherein the closure is formed such that the flip-top lid is integrally joined to the closure body, and the flip-top lid is in its open position. Prior to application to an associated container, the flip-top lid is moved to its closed position, and the tamper-indicating flange inserted into the retention cavity of the closure body. In this configuration of the closure, the closure can be readily stored and shipped, and applied to an associated container.

During initial opening movement of the flip-top lid, such as by a consumer for dispensing the container's contents, the frangible connection joining the tamper-indicating flange to the main body of the lid is fractured and broken, permitting the lid to be easily pivoted to its open position. The contents in the container can then be conveniently dispensed. The tamper-indicating flange is retained in the retention cavity, and does not interfere with normal opening and closing of the flip-top lid to permit repeated dispensing of the container's contents as desired.

In accordance with the illustrated embodiment, the retention cavity is defined by a cavity wall connected in spaced relation to the annular skirt portion of the closure body. The retention cavity includes at least one retention lug positioned between the cavity wall and the skirt portion. The tamper-indicating flange of the flip-top lid defines at least one retention hook for engaging the retention lug when the flange is received in the retention cavity in the closed position of the lid. In the preferred form, the retention cavity includes a pair of retention lugs positioned at respective opposite ends thereof, while the tamper-indicating flange defines a pair of retention hooks at respective opposite edges thereof for respectively engaging the pair of retention lugs.

Other features and advantages of the present invention will become readily apparent from the following detailed description, the accompanying drawings, and the appended claims.

DETAILED DESCRIPTION

Figure 1:
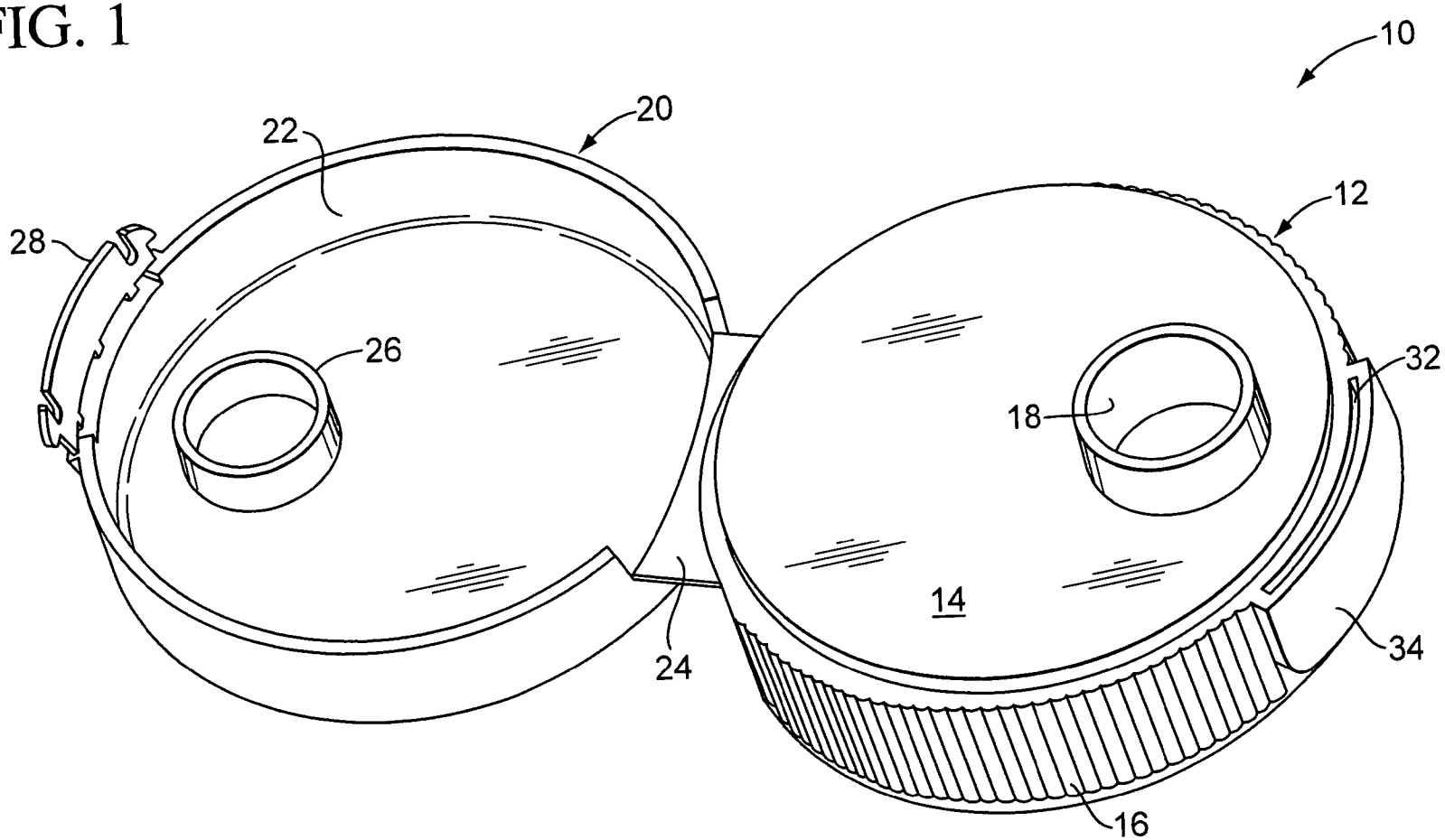
FIG. 1 is a perspective view of the present tamper-indicating dispensing closure illustrating the closure in an open position.
Figure 2:
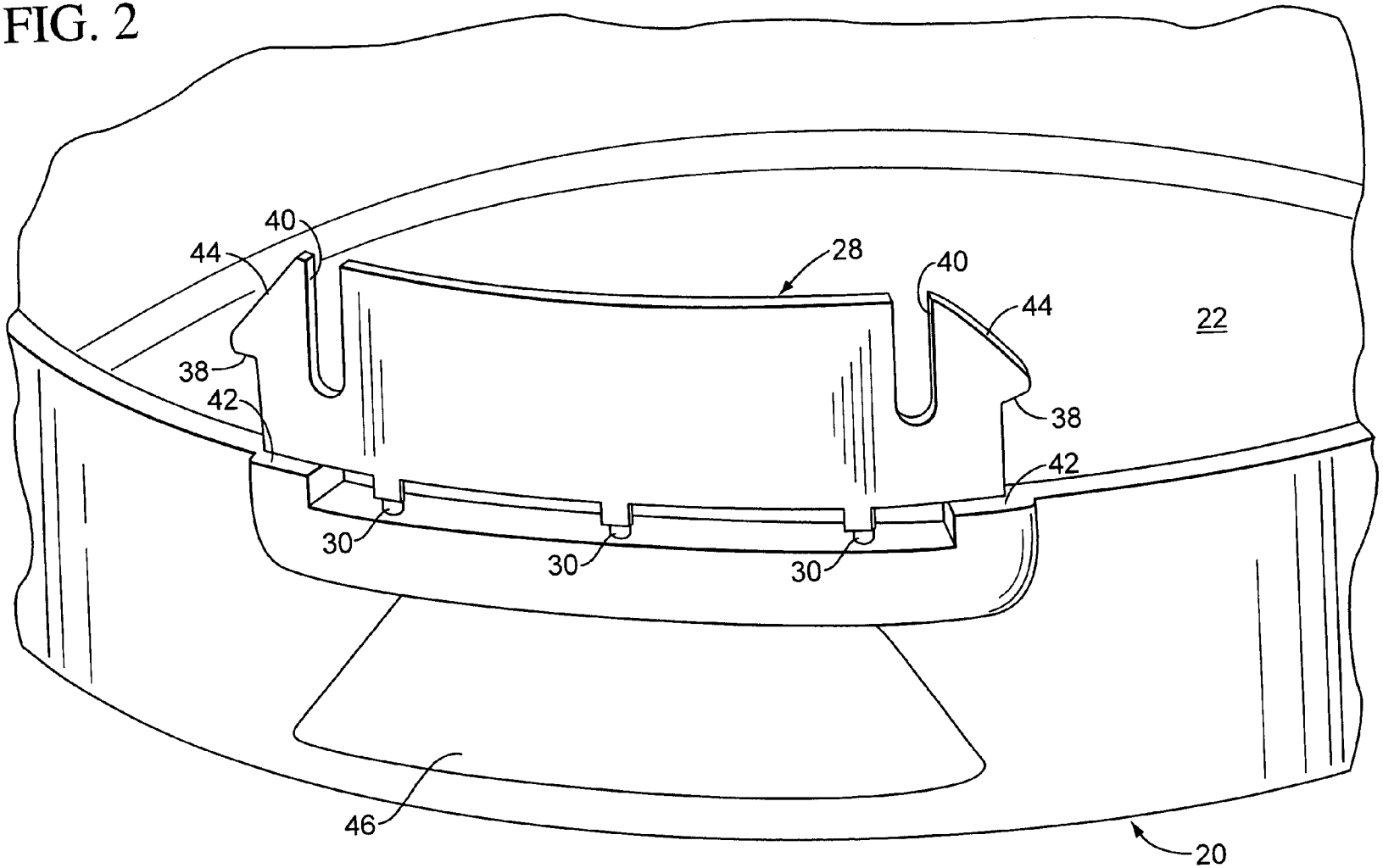
FIG. 2 is a relatively enlarged, perspective view of a closure body of the present dispensing closure.
Figure 3:
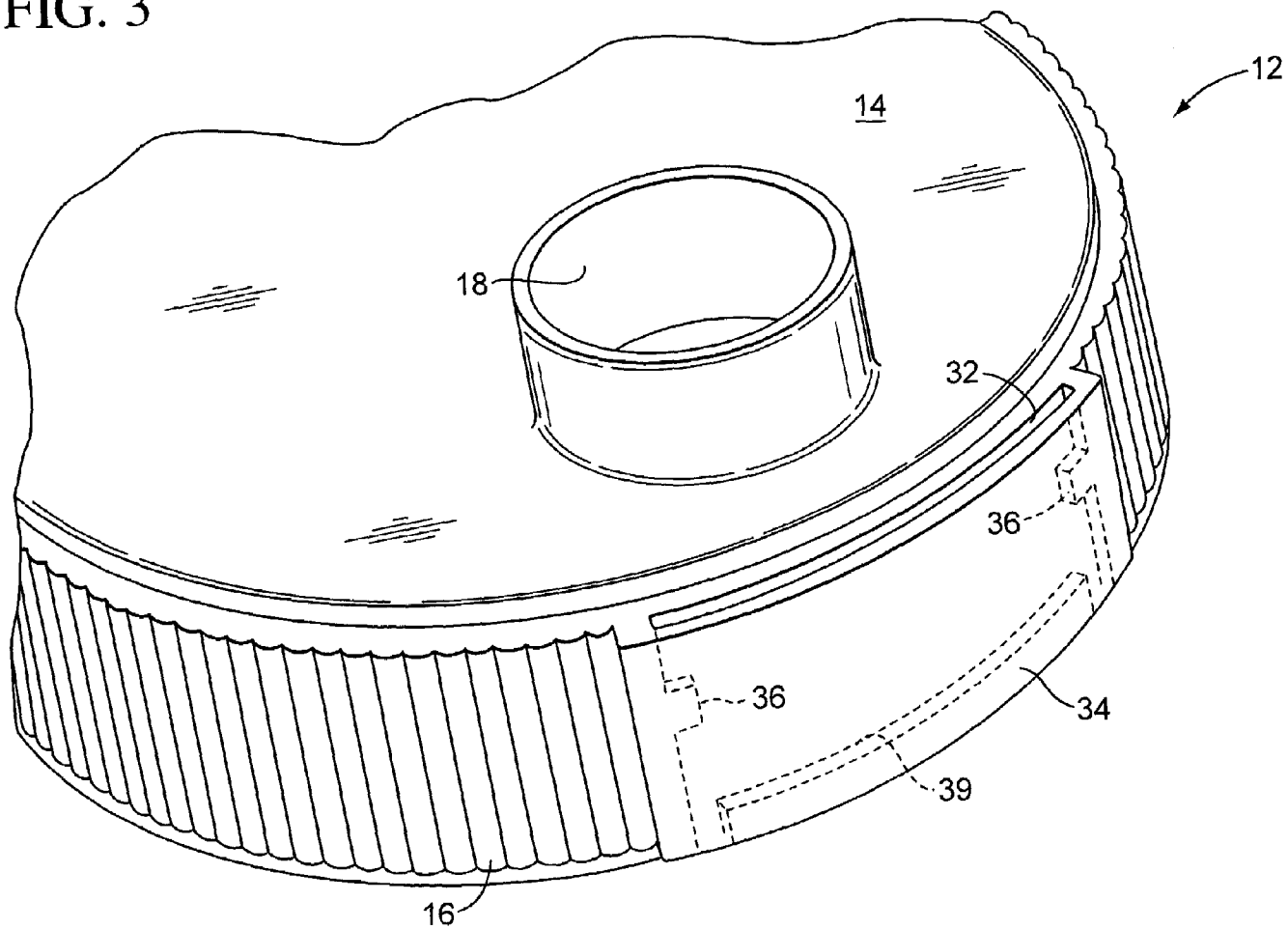
FIG. 3 is a relatively enlarged, perspective view of a flip-top lid of the present dispensing closure.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference first to FIG. 1, therein is illustrated a one-piece tamper-indicating dispensing closure 10 embodying the principles of the present invention. As will be recognized by those familiar with the art, dispensing closure 10 is sometimes referred to as a flip-top closure, in that it includes an integral lid portion which can be moved between an open position and a closed position with respect to a body of the closure, thereby opening and closing a dispensing opening of the closure. This type of closure can be efficiently formed from suitable polymeric material, such as polypropylene, typically by injection molding. During manufacture of the present closure by injection molding, the closure is ordinarily molded in the open position illustrated in FIG. 1.

Dispensing closure 10 includes a closure body 12 having a top wall portion 14 and an annular, depending skid portion 16. The top wall portion 14 defines a dispensing opening 18 for dispensing the contents from an associated container (not shown) to which the closure body is fitted. To this end, the skid portion 16 can include an internal thread formation, an internal retention bead, internal retention lugs, or the like for effecting securement of the dispensing closure 10 to an associated container.

The dispensing closure 10 further includes a flip-top lid 20 including a main body 22, joined to closure body 12 for movement between a closed position covering the dispensing opening 18, and an open position wherein the dispensing opening is uncovered. The flip-top lid 20 is preferably joined to closure body 12 by a flexible, unitary living hinge 24 which permits pivotal movement of the flip-top lid with respect to the closure body. In accordance with the illustrated embodiment, flip-top lid 20 can include a plug seal element 26 which is positionable generally within dispensing opening 18 in the closed position of the lid to facilitate sealing of the opening.

In accordance with the present invention, the dispensing closure 10 is configured for tamper-indication, that is, to provide readily visually discernable evidence that the flip-top lid 20 has been previously opened after its initial movement into its closed position with respect to the closure body 12. To this end, the flip-top lid 20 includes a tamper-indicating flange 28 which depends from the main body 22 of the flip-top lid, and is joined thereto by a frangible connection. In the preferred form, the frangible connection is provided by a plurality of spaced apart frangible bridges 30 which fracturably retain the tamper-indicating flange 28 on the main body of the lid 20.

Tamper-indication is further provided by a pocket-like retention cavity 32 defined by the closure body 12, with the retention cavity configured for receiving the tamper-indicating flange 28 when the flip-top lid 20 is in its closed position. The retention cavity 32 is defined by a cavity wall 34 connected in spaced relationship to annular skirt portion 16 of the closure body. Cavity well 34 is permanently connected to the skirt portion 16, with permanent non-removable retention of flange 28 within cavity 32 contemplated to avoid the creation of any loose or detachable elements when the closure 10 is opened and manipulated to provide tamper-indication.

Permanent retention of tamper-indicating flange 28 in retention cavity 32 is effected by the provision of at least one, and preferably a pair, of retention lugs 36 positioned between cavity wall 34 and skirt portion 36. The pair of retention lugs 36 are preferably positioned at respective opposite ends of the retention cavity 32.

Retention of the flange 28 in the cavity 32 is further effected by the provision of at least one, and preferably a pair, of retention hooks 38 defined by the flange 28, with a pair of the retention hooks 38 preferably provided at respective opposite edges of the flange for respectively engaging the pair of retention lugs 36.

Highly desirable resistance to teampering is enhanced by configuring retention cavity 34 to include a lower wall 39 which extends integrally between cavity wall 34 and skirt portion 16. The opposite ends of lower wall 39 can be spaced inwardly from respective ends of the retention cavity to facilitate molding of retention lugs 36. Lower wall 39 desirably acts to protect tamper-indicating flange 28 as it is held captive within retention cavity 32, and thus acts to deter unauthorized manipulation of the flange 28 if an effort is made to defeat its tamper-indicating function. Reliable tamper-indication is thus enhanced.

During initial closing of the flip-top lid 20, tamper-indicating flange 28 is inserted into retention cavity 32 and retention hooks 38 deformed sufficiently so as to pass between, and then respectively engage beneath the retention lugs 36. To facilitate insertion of the flange in this manner, the flange preferably defines a slot-like, generally elongated opening 40 positioned adjacent to each retention hook to facilitate flexure of the hook as it engages the respective retention lug 36. To facilitate this movement, the flange 28 preferably defines a guide surface 42 generally adjacent each retention hook 28 for facilitating engagement of the retention lug 36 with the respective retention hook 38.

In order to urge the tamper-indicating flange 28 into the retention cavity 32 during initial closing of the flip-top lid 20, the main body 22 of the lid preferably defines at least one, and preferably a pair, of abutment surfaces 44 engageable with tamper-indicating flange 28 for urging the flange into the retention cavity during initial closing of the flip-top lid by movement of the lid from an open position to its closed position. The abutment surfaces desirably act to transfer forces exerted on the lid to the flange 28 without excessive loading of the frangible bridges 30.

From the foregoing, use of the present tamper-indicating dispensing closure will be readily appreciated. After the formation of the closure in the open position illustrated in FIG. 1, the flip-top lid 20 can be pivotally moved to its closed position, by flexing movement of living hinge 24. As plug seal 26 is inserted into dispensing opening 18, tamper-indicating flange 28 is inserted into retention cavity 32 as the flip-top lid 20 is initially moved to its fully closed position. During insertion of the flange 28 into the retention cavity 32, guide surfaces 42 engage and co-act with the retention lugs 36, urging the retention hooks 38 of the flange 28 generally toward each other as they pass between the retention lugs 36. As the hooks 33 pass beneath the retention lugs 36, the resilient nature of the retention flange 28 causes the hooks 38 to be urged away from each other, and into respective engagement with the retention lugs 36. The flip-top lid 20 is now retained in its closed position, with the closer 10 ready for storage, shipment, and application to an associated container.

Initial opening movement of the flip-top lid 20 facilitated by finger-lift 46. During this initial opening movement, engagement of retention hooks 38 with retention lugs 36 firmly retains the tamper-indicating flange within retention cavity 32. An opening force is applied to the lid which acts to fracture and break frangible bridges 30, whereby the tamper-indicating flange 28 is retained in the retention cavity 32 as the lid 20 is pivotally moved to its open position. The contents of the container to which the closure 10 is fitted can thereafter be conveniently dispensed through dispensing opening 18. When dispensing is complete, the lid 20 can be easily returned to its closed position by pivoting about hinge 24. While tamper-indicating flange 28 is retained within retention cavity 32, and thus desirably does not become loose, the flange 28 is in an out-of-the-way disposition within the retention cavity 32, and does not interfere with the normal opening and closing of the lid 20 for dispensing the container's contents. Desirably, the retention flange 28 is permanently retained within the retention cavity 32.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A tamper-indicating dispensing closure, comprising a closure body having a top wall, a first skirt depending from said top wall, a dispensing opening provided in said top wall, and a retention cavity extending radially outwardly from said first skirt, said retention cavity including an inner wall defined by a portion of said first skirt, an outer wall spaced from said inner wall, a first sidewall extending between said inner and outer walls at one end of said retention cavity, and a second sidewall extending between said inner and outer walls at an opposite end of said retention cavity, said closure body including a first retention lug extending into said retention cavity from said first sidewall, and a second retention lug extending into said retention cavity from said second sidewall; and a flip-top lid connected to said closure body for movement between a closed position, in which said flip-top lid covers said dispensing opening, and an opened position, in which said dispensing opening is not covered by said flip-top lid, said flip-top lid including a second skirt having an edge surface which is engageable with said top wall of said closure body when said flip-top lid is in its closed position, a tamper-indicating flange depending from said edge surface such that said tamper-indicating flange is receivable by said retention cavity when said flip-top lid is in its closed position, said tamper-indicating flange including a first retention hook positioned at one end of said flange so as to be engageable with said first retention lug when said flip-top lid is in its closed position, and a second retention hook positioned at an opposite end of said flange so as to be engageable with said second retention lug when said flip-top lid is in its closed position, and at least one frangible member connecting said tamper-indicating flange to said edge surface such that said at least one frangible member fractures when said flip-top lid is initially moved from its closed position to its opened position, whereby said tamper-indicating flange is permanently retained within said retention cavity upon its disconnection from said flip-top lid.

2. The tamper-indicating dispensing closure of claim 1, wherein said tamper-indicating flange includes a first edge positioned proximate to said edge surface of said flip-top lid when said tamper-indicating flange is connected to said flip-top lid, and a second edge positioned distal from said edge surface of said flip-top lid when said tamper-indicating flange is connected to said flip-top lid.

3. The tamper-indicating dispensing closure of claim 2, wherein said tamper-indicating flange includes a first opening formed in said second edge of said flange and positioned adjacent to said first retention hook to facilitate flexure of said first retention hook in response to its engagement with said first retention lug, and a second opening formed in said second edge of said tamper-indicating flange and positioned adjacent to said second retention hook to facilitate flexure of said second retention hook in response to its engagement with said second retention lug.

4. The tamper-indicating dispensing closure of claim 3, wherein said first retention hook includes a first guide surface engageable with said first retention lug when said flip-top lid is moved from its opened position to its closed position for facilitating engagement of said first retention hook with said first retention lug, and said second retention hook includes a second guide surface engageable with said second retention lug when said flip-top lid is moved from its opened position to its closed position for facilitating engagement of said second retention hook with said second retention lug.

5. The tamper-indicating dispensing closure of claim 4, wherein each of said first and second guide surfaces are angled relative to said second edge of said tamper-indicating flange.

6. The tamper-indicating dispensing closure of claim 5, wherein said at least one frangible member includes a plurality of spaced-apart frangible members.

7. The tamper-indicating dispensing closure of claim 6, wherein each of said plurality of frangible members is connected to said first edge of said tamper-indicating flange prior to disconnection of said tamper-indicating flange from said flip-top lid.

8. The tamper-indicating dispensing closure of claim 7, wherein said edge surface of said flip-top lid includes a first abutment positioned proximate to said first retention hook of said tamper-indicating flange such that said first abutment is engageable with said first edge of said flange as said flip-top lid is moved from its opened position to its closed position, and a second abutment positioned proximate to second first retention hook of said flange such that said second abutment is engageable with said first edge of said flange as said flip-top lid is moved from its opened position to its closed position.

9. The tamper-indicating dispensing closure of claim 8, wherein said retention cavity includes a lower wall extending between said first and second sidewalls thereof and between said inner and outer walls thereof.

10. The tamper-indicating dispensing closure of claim 9, wherein said lower wall of said retention cavity includes a first end spaced from said first sidewall of said retention cavity and a second end spaced from said second sidewall of said retention cavity.

11. The tamper-indicating dispensing closure of claim 10, wherein said flip-top lid includes a plug seal that is releasably inserted within said dispensing opening of said closure body when said flip-top lid is in its closed position.

12. The tamper-indicating dispensing closure of claim 11, wherein said plurality of frangible members includes three frangible members.

13. The tamper-indicating dispensing closure of claim 12, wherein said closure body includes attachment means for attaching said tamper-indicating dispensing closure to a container.

14. The tamper-indicating dispensing closure of claim 13, wherein said flip-top lid is formed integrally with said closure body.

15. The tamper-indicating dispensing closure of claim 14, further comprising connecting means for movably connecting said flip-top lid to said closure body.

16. The tamper-indicating dispensing closure of claim 15, wherein said connecting means includes a hinge.

17. The tamper-indicating dispensing closure of claim 16, wherein said first skirt of said closure body is round, and said second skirt of said flip-top lid is round.

* * * * *